US009731427B2

(12) United States Patent
Gratsias et al.

(10) Patent No.: US 9,731,427 B2
(45) Date of Patent: Aug. 15, 2017

(54) RAZOR HANDLE COMPRISING INSERTS WITHIN HOLES AND RAZOR COMPRISING SUCH A RAZOR HANDLE

(71) Applicant: BIC-VIOLEX SA, Anixi, Attiki (GR)

(72) Inventors: Spiros Gratsias, Kipseli-Athens (GR); Ioannis Marios Psimadas, Vrilissia-Athens (GR); Georgios Georgakis, Melisia (GR); Efstratios Christofidellis, Kifisia (GR)

(73) Assignee: BIC VIOLEX S.A., Anixi (GR)

( * ) Notice: Subject to any disclaimer, the term of this patent is extended or adjusted under 35 U.S.C. 154(b) by 0 days.

(21) Appl. No.: 14/762,057

(22) PCT Filed: Jul. 10, 2014

(86) PCT No.: PCT/EP2014/064805

§ 371 (c)(1),
(2) Date: Jul. 20, 2015

(87) PCT Pub. No.: WO2015/128009

PCT Pub. Date: Sep. 3, 2015

(65) Prior Publication Data

US 2016/0250765 A1 Sep. 1, 2016

(30) Foreign Application Priority Data

Feb. 28, 2014 (WO) ..... PCT/EP2014/054008

(51) Int. Cl.
*B26B 21/52* (2006.01)

(52) U.S. Cl.
CPC ..... *B26B 21/522* (2013.01)

(58) Field of Classification Search
CPC ..... B26B 21/522; B26B 21/14; B26B 21/528
USPC ..... 30/526–535
See application file for complete search history.

(56) References Cited

U.S. PATENT DOCUMENTS 2,189,689 A * 2/1940 Thompson ..... B26B 21/52 30/526
4,028,803 A * 6/1977 Currie ..... A47G 21/02 16/430
4,721,021 A * 1/1988 Kusznir ..... B25G 1/01 81/22
5,031,319 A * 7/1991 Althaus ..... B26B 21/522 30/526
5,361,766 A * 11/1994 Nichols ..... A61B 5/1076 600/431

(Continued)

FOREIGN PATENT DOCUMENTS

JP 10-43444 2/1998
WO WO 97/37819 10/1997
WO WO 2006/081838 A1 8/2006

OTHER PUBLICATIONS

International Report of PCT/EP2014/064805; Nov. 20, 2014.

*Primary Examiner* — Sean Michalski
(74) *Attorney, Agent, or Firm* — Polsinelli PC

(57) ABSTRACT

A razor handle that includes an elongated body extending in a longitudinal direction (C), the elongated body having an outer surface and being provided with a first hole and a second hole, the first and second holes opening on the outer surface of the elongated body, the razor handle that includes a first insert and a second insert, the first and second inserts being respectively partially encapsulated within the first and second holes.

33 Claims, 10 Drawing Sheets

(56) References Cited

U.S. PATENT DOCUMENTS 5,497,551 A * 3/1996 Apprille, Jr. ..... B26B 21/52 30/526
5,784,790 A * 7/1998 Carson, III ..... B26B 21/225 30/527
5,915,847 A * 6/1999 Spears ..... E03C 1/262 4/287
6,837,637 B1 * 1/2005 Beck ..... A61K 8/8152 15/443
6,915,576 B2 * 7/2005 Brzezinski ..... B26B 21/46 30/123
D511,223 S * 11/2005 Miyazaki ..... B26B 21/222 D28/48
D587,846 S * 3/2009 Wonderley ..... B26B 21/222 D28/48
7,757,333 B2 * 7/2010 Battaglia ..... A46B 5/0025 15/167.1
7,874,076 B2 * 1/2011 Gratsias ..... B26B 21/522 16/430
D636,938 S * 4/2011 White, Jr. ..... B26B 21/222 D28/48
7,975,389 B2 * 7/2011 Bozikis ..... B26B 21/522 30/32
8,151,469 B2 * 4/2012 Schulz ..... B26B 21/522 30/50
2004/0216311 A1 11/2004 Follo
2005/0198841 A1 * 9/2005 Worrick ..... B26B 21/222 30/527
2006/0037160 A1 * 2/2006 Kayser ..... A46B 5/0075 15/167.1
2008/0078086 A1 * 4/2008 Wang ..... B26B 21/40 30/50
2009/0158600 A1 * 6/2009 Ishai ..... B25G 1/00 30/314
2009/0255136 A1 * 10/2009 Blackburn ..... B26B 21/225 30/526
2010/0064521 A1 * 3/2010 Delong ..... B26B 21/52 30/41
2014/0230255 A1 * 8/2014 Stevens ..... B26B 21/40 30/526
2016/0136827 A1 * 5/2016 Gulledge ..... B26B 21/521 30/526
2016/0250766 A1 * 9/2016 Gratsias ..... B26B 21/522

* cited by examiner

RAZOR HANDLE COMPRISING INSERTS WITHIN HOLES AND RAZOR COMPRISING SUCH A RAZOR HANDLE

This application is a national stage application of International Application No. PCT/EP2012/064805, filed on Feb. 28, 2014, the entire contents of which are incorporated herein by reference.

The embodiments of the present invention relate to razor handles and razors.

BACKGROUND OF THE INVENTION

More precisely, the embodiments of the present invention relate to a razor handle that includes an elongated body extending in a longitudinal direction, the elongated body having an outer surface and being provided with a first hole and a second hole, the first and second holes opening on the outer surface of the elongated body, the razor handle further that includes a first insert and a second insert.

WO 2008147133 discloses an example of such a known razor handle in which several inserts are provided on different faces of the razor handle so as to provide a proper weight to the handle assembly and prevent the deformation of the elongated body.

However, these inserts consist in several different pieces with complex shapes; therefore, a razor handle provided with such inserts is difficult to assemble and to manufacture. In addition, each of these inserts can inadvertently be detached from the razor handle.

SUMMARY OF THE INVENTION

One objective of the embodiment of the present invention is to avoid these drawbacks. More specifically, one problem of the invention is to facilitate the manufacture of the razor handle according to the invention.

Another problem is to improve the shaving experience of the user while shaving.

Another problem is to avoid any inadvertent separation of any of the inserts provided on razor handle according to the invention.

This problem is solved by the fact that, according to the invention, the first and second inserts are respectively partially encapsulated within the first and second holes.

Thanks to the inserts, the razor handle can also have a proper weight ensuring a precise and comfortable shaving while providing an advantage for mass produced shavers.

In addition, since the inserts are encapsulated within the elongated body, they cannot be detached from the first and second holes; they especially cannot be detached from the hole by a user. Also, such a razor handle has a better hold and an improved resistance.

Thanks to the inserts, the razor handle can also have a proper weight promoting a comfortable shaving. The inserts allow the razor handle to have a good balance regardless the shape of the handle.

Furthermore, such a razor handle according to the present invention can be easily recycled by separating the material of the inserts from the material of the elongated body.

The invention also concerns a razor handle that includes an elongated body extending in a longitudinal direction, the elongated body having an outer surface and being provided with a first hole, the first hole opening on the outer surface of the elongated body, the razor handle further that includes a first insert, the first insert being a sphere which is partially encapsulated within the first hole and the razor handle having, in cross section, a general trapezoidal shape with smooth corners in the vicinity of the first hole.

In advantageous embodiments of such razor handles, one and/or the other of the following features may be incorporated:

- the razor handle extends between a front end and a rear end, the rear end being opposite the front end, the front end being provided with connecting means, the first insert being located in the vicinity of the front end and the first insert being immovable within the first hole, the immovable first insert forming a finger rest area.

Consequently, the user can position one or several of his fingers on the first insert to grasp the handle. The razor handle thus provides a good shaving experience with such a razor handle.

- The first insert is movable within the first hole;
- the second insert is immovable within the second hole, the immovable second insert forming a finger rest area.

Consequently, the user can position one or several of his fingers on the second insert to grasp the handle.

The razor handle thus provides a good shaving experience with such a razor handle.

The elongated body is a unitary element and that includes a first material chosen among the plastics and the rubbers;

- the first and second inserts are made in a rigid material having a density that is different from the density of the first material of the elongated body.

When the inserts comprise a material having a density that is greater than the density of the first material of the elongated body, the presence of the inserts result in an increase of the weight of the razor handle which improve the user's perception while shaving. This increase of weight can be achieved by reducing the use of first material and still maintaining a good shaver handle design. The size and shape of the razor handle may be then reduced but may still keep an ergonomic shape.

- the first and second inserts that includes a material chosen among the metals, the plastics and the rubbers;
- at least one of the first and second inserts is a sphere; each of the first and second inserts can be a sphere.
- the first and second inserts each has a diameter which is comprised between 10 mm and 20 mm;
- the elongated body has an upper face and a lower face, the lower face being opposite the upper face, the first and second holes being through-holes extending between the upper and lower faces;
- the elongated body has an upper face and a lower face, the lower face being opposite the upper face, at least a part of the upper face and at least a part of the lower face being covered with a second material so that the parts respectively form at least an upper gripping area and at least a lower gripping area;
- the elongated body has two lateral sides opposite to each other and extending in the longitudinal direction between the upper and lower faces, the lateral sides that includes a plurality of smooth ribs made of the second material, each of the smooth ribs connecting together the upper gripping area and the lower gripping area;
- the razor handle extends between a front end and a rear end, the rear end being opposite the front end, the front end being provided with connecting means for connection to a shaving cartridge;
- the razor handle has, in cross section, a general trapezoidal shape with smooth corners in the vicinity of the rear end;

the first insert is located in the vicinity of the front end, whereas the second insert is located in the vicinity of the rear end;

the first insert is centered on a first point which is located at a distance measured along the longitudinal direction of about 30 mm from the front end;

the second insert is centered on a second point which is located at a distance measured along the longitudinal direction of about 20 mm from the rear end;

the distance between the first point and the second point measured along the longitudinal direction is comprised between 70 mm and 90 mm;

each lateral sides that includes a plurality of spaced protruding pins in the vicinity of the front end of the razor handle;

the first hole has an interior lateral wall, a retaining ring protruding from the interior lateral wall and surrounding circumferentially, at least partially, the first insert for maintaining the first insert within the first hole;

the second hole is divided by an elongated bar extending in the longitudinal direction, the elongated bar that includes a portion that surrounds circumferentially, at least partially, the second insert for maintaining the second insert within the second hole;

the second hole that includes an interior lateral wall, the second hole further that includes two projections opposite each other, protruding from the interior lateral wall, and having a shape which is partly complementary to the shape of the second insert for maintaining the second insert within the second hole;

each of the first and second holes delimits an interior space comprised inside the elongated body, the first and second inserts having a size which is respectively inferior to the interior spaces of the first and second holes; and the razor handle has, in cross section, a general trapezoidal shape with smooth corners.

The invention also concerns a razor that includes such a razor handle and a shaving cartridge connected to the razor handle.

The above and other objects and advantages of the invention will become apparent from the detailed description of one embodiment of the invention, considered in conjunction with the accompanying drawings.

DETAILED DESCRIPTION OF THE EMBODIMENTS OF THE PRESENT INVENTION

In the various figures, the same references denote identical or similar elements.

Figure 1:
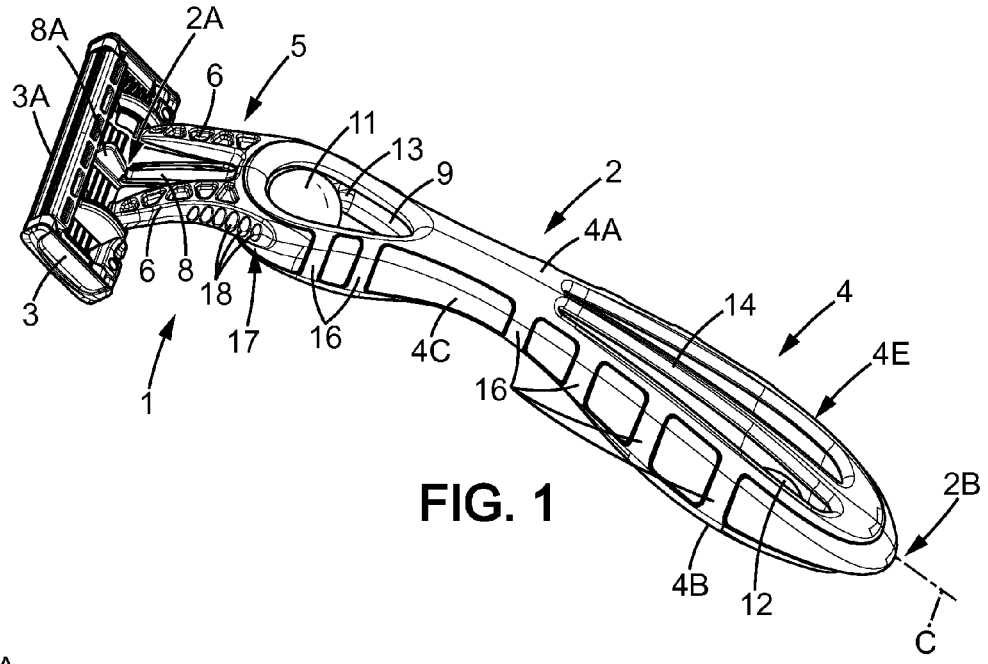
FIG. 1 is a perspective view of a razor according to the invention that includes a razor handle connected to a shaving cartridge.
Figure 2:
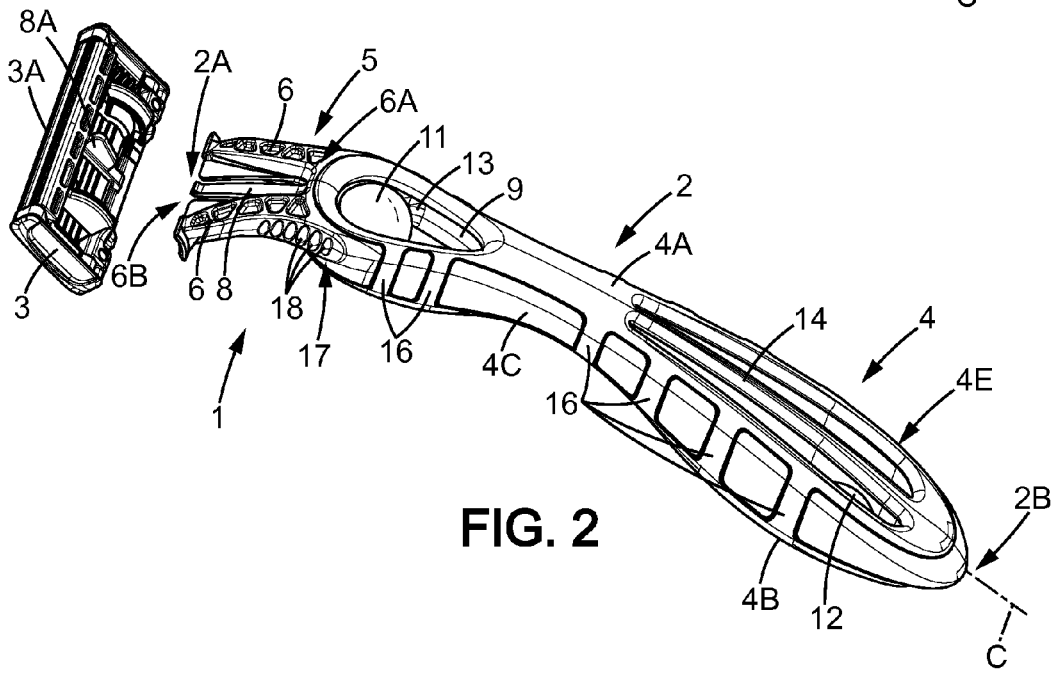
FIG. 2 is a perspective view of the razor of FIG. 1, the shaving cartridge being released from the razor handle.

FIG. 1 illustrates a wet shaving razor 1. The embodiment of the present invention that includes a razor handle 2 and a shaving cartridge 3. The shaving cartridge 3 is preferably a disposable shaving cartridge, that includes one or several blades 3A, which can be connected to or release from the razor handle 2 as shown respectively on FIGS. 1 and 2.

The razor handle 2 has a generally curved shape (viewed laterally) and extends in a longitudinal direction C between a front end 2A and a rear end 2B, the rear end 2B being opposite the front end 2A. The razor handle 2 has also an elongated body 4 for hand grasping the razor handle 2. More precisely, the elongated body 4 extends longitudinally from the rear end 2B to a location near the front end 2A. The razor further that includes connecting means 5 in the continuation of the elongated body 4 up to the front end 2A. In other words, the elongated body 4 extends longitudinally from the rear end 2B to the beginning of the connecting means 5. The shaving razor 1 extends longitudinally from the rear end 2B to the free end of the connecting means 5 (the free end being the one to be connected to the shaving cartridge 3).

Figure 3A:
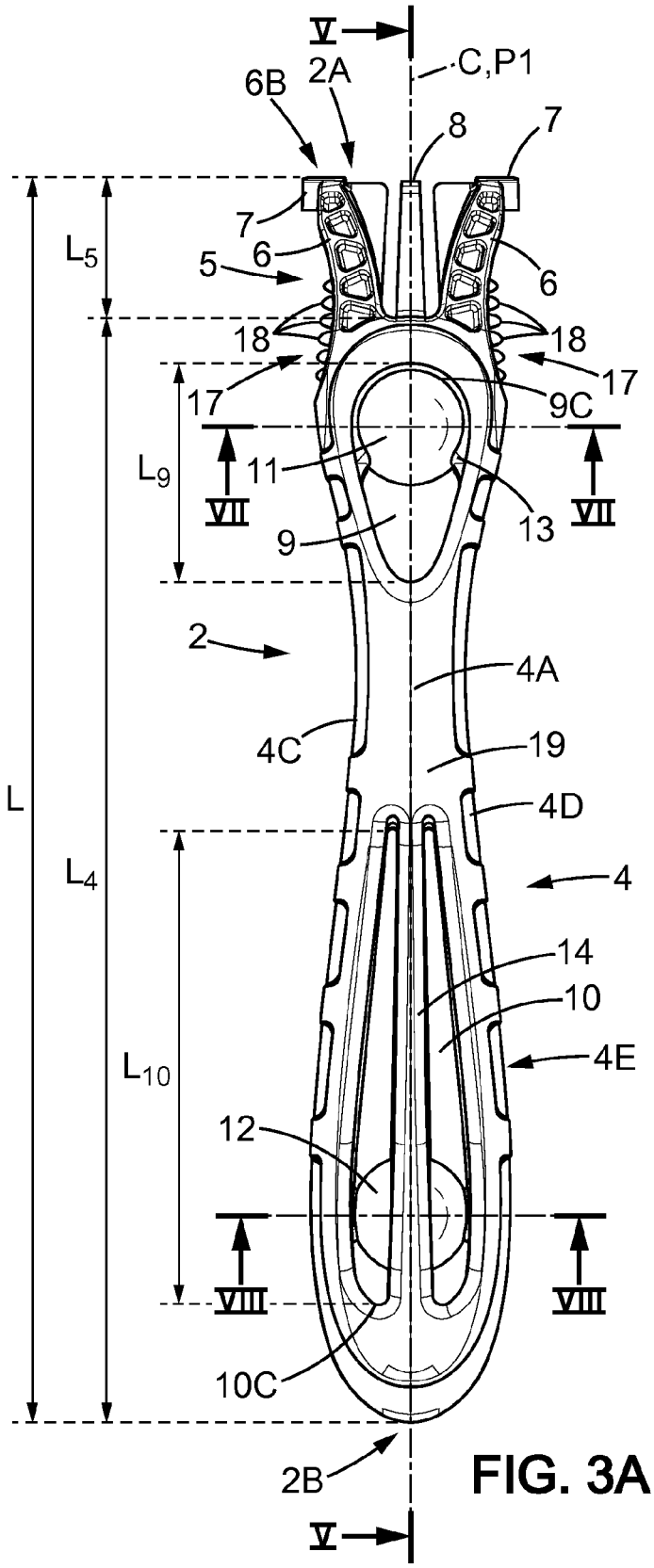
FIGS. 3A and 3B are respectively an upper and a lower view of the razor handle of FIG. 1.
Figure 3B:
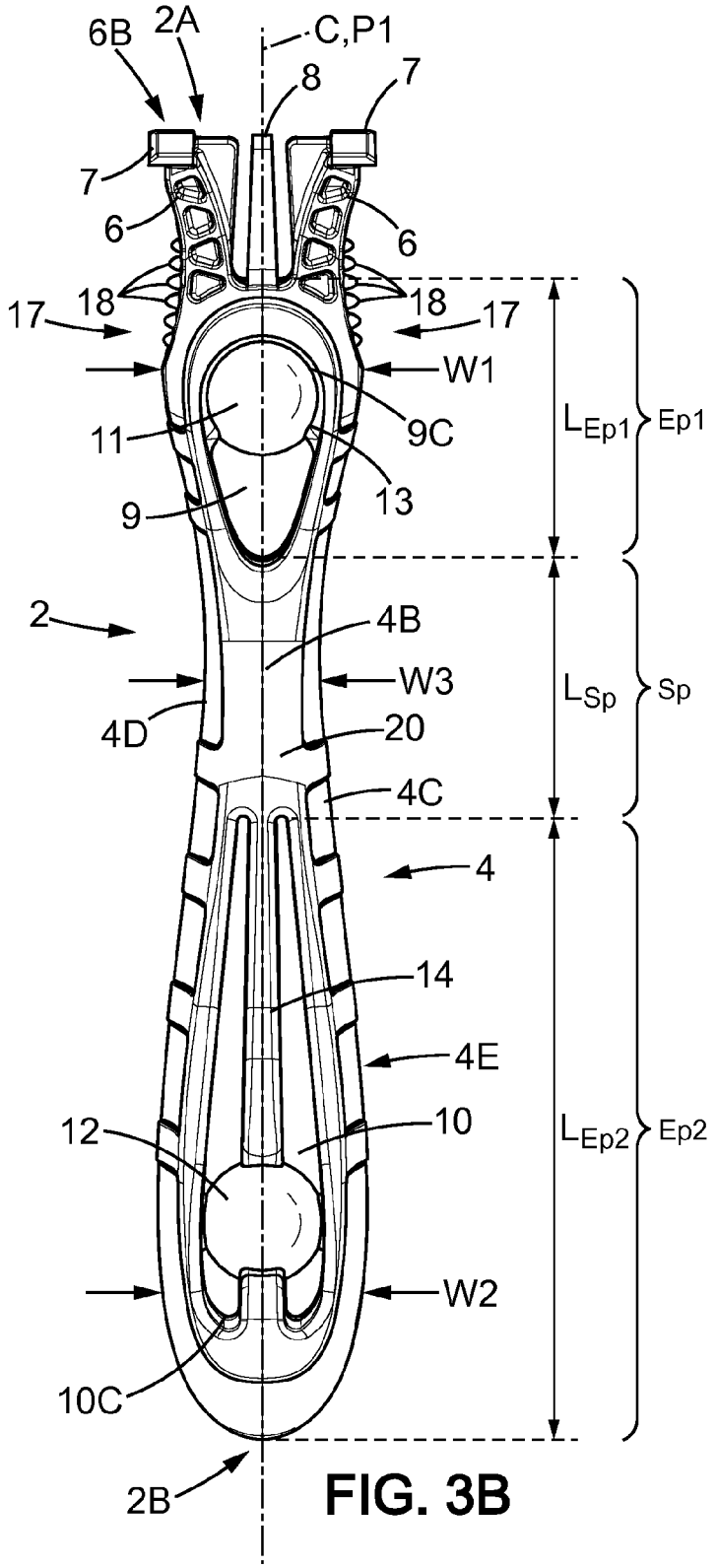

Referring to FIGS. 3A and 3B, it can be seen that the razor handle 2 can be symmetrical with respect of a median plane P1 and has a length L in the longitudinal direction C which is comprised between 100 mm and 150 mm, preferably about 125 mm. The length L4 of the elongated body 4 is about 100 mm to about 120 mm, whereas the length L5 of the connecting means 5 is about 15 to 25 mm.

In a preferred embodiment, the length L of the razor handle 2 is of about 126 mm. The length L5 of the connecting means 5 is of about 17 mm. The length L4 of the elongated body 4 is of about 108 mm.

Figure 4:
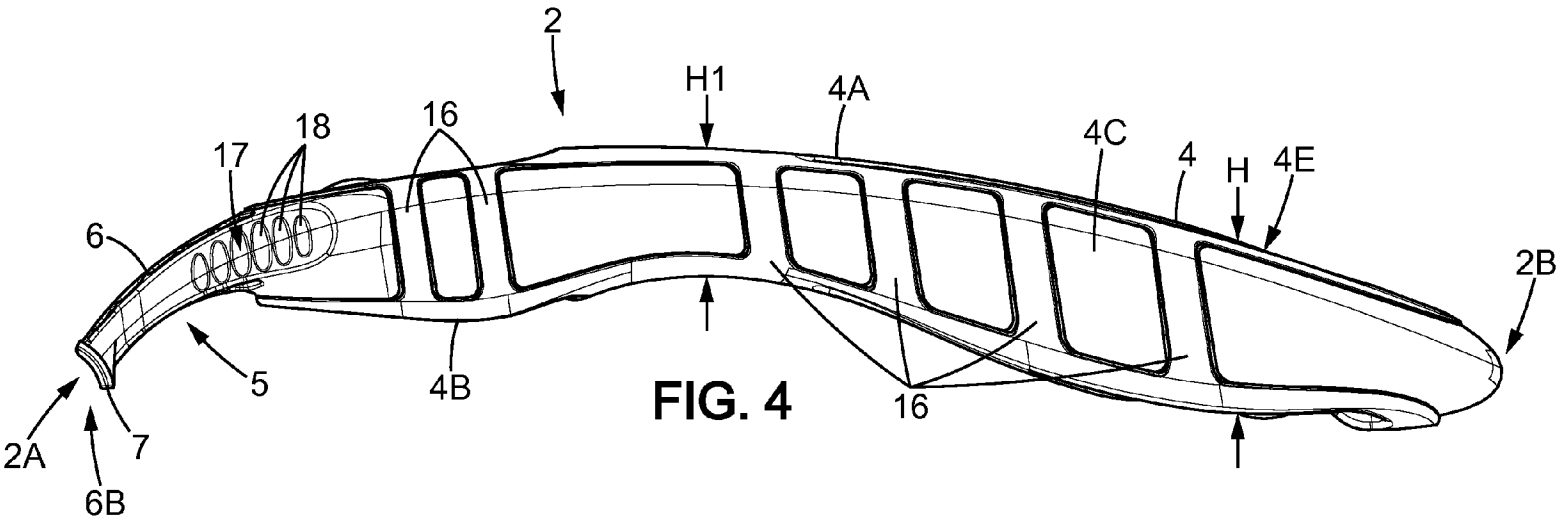
FIG. 4 is a side view of the razor handle of FIG. 1.

The razor handle 2 may also define a variable height H and a width W along the length L thereof. The height H of the razor handle 2 may vary along the direction C but is preferably comprised between 15 mm and 25 mm, preferably about 20 mm. As depicted in FIG. 4, the smallest height H1 of the elongated body 4 is located about the center of the razor handle 2.

It can be seen on the upper and lower views of the razor handle 2 of FIGS. 3A and 3B, that the razor handle 2 has also a first enlarged part Ep1 in the vicinity of the front end 2A, having a width W1 which is maximized. The elongated body also that includes a second enlarged part Ep2 located in the vicinity of the rear end 2B of the razor handle 2 having a width W2 which is maximized. The first and second enlarged parts Ep1, Ep2 are connected together by a slim part Sp located about at the centre of the razor handle 2. In particular, the slim part Sp has a width W3 which is minimized. The first enlarged part Ep1 extends from this slim part Sp to the connecting means 5, whereas the second enlarged part Ep2 extends from the rear end 2B to this slim part Sp. The first and of the second enlarged part Ep1, Ep2 have a length LEp1, LEp2 along the longitudinal direction C which are respectively chosen such that the connection between the first and second enlarged parts Ep1, Ep2 with the slim part Sp have a smooth curvature.

In a preferred embodiment, the length LEp1 of the first enlarged part Ep1 is of about 25 mm. The length LEp2 of the second enlarged part Ep2 is of about 50 mm. The length LSp of the slim part Sp is of about 25 mm.

Figure 10:
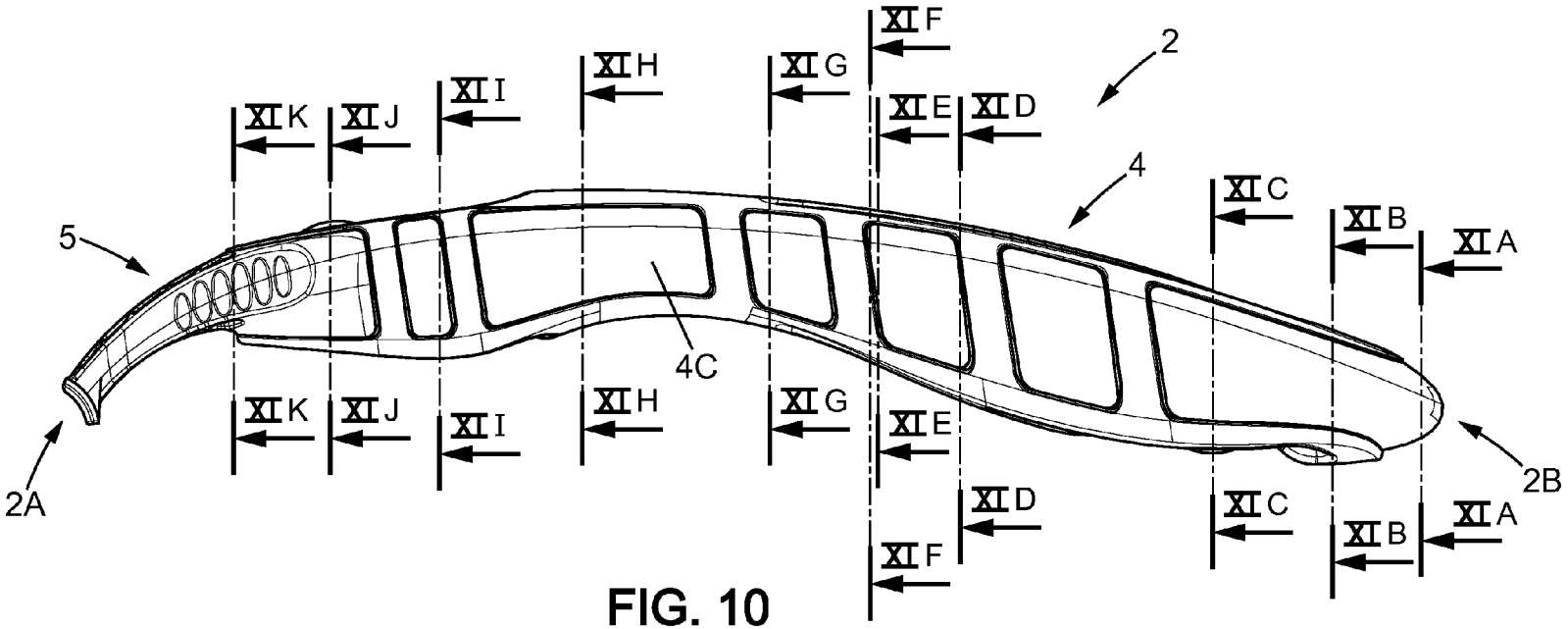
FIG. 10 is a side view of the razor handle of FIG. 1.
Figure 11A:
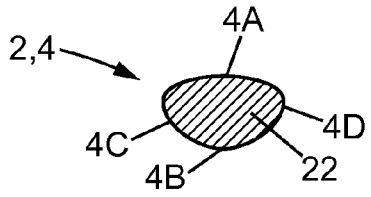
FIGS. 11A to 11K are cross sectional views of the razor handle of FIG. 10, taken respectively along the lines XIA-XIA to XIK-XIK.
Figure 11B:
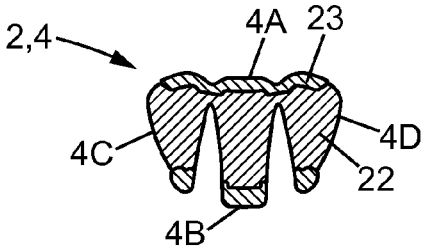
Figure 11C:
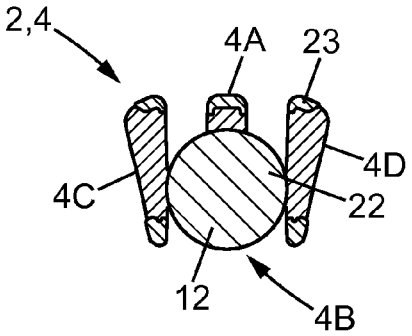
Figure 11D:
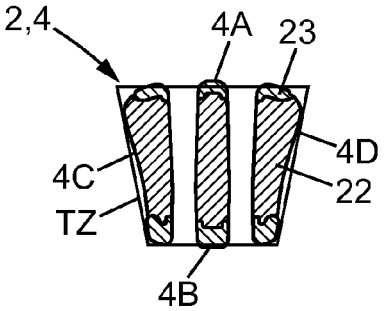
Figure 11E:
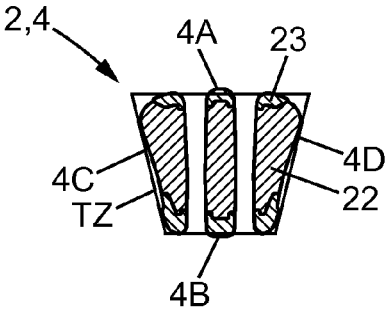
Figure 11F:
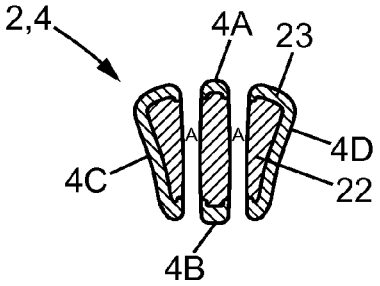
Figure 11G:
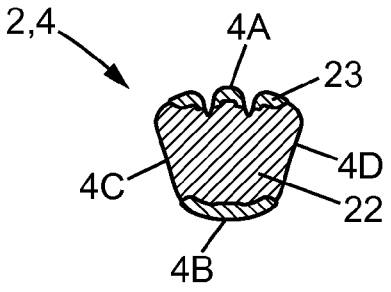
Figure 11H:
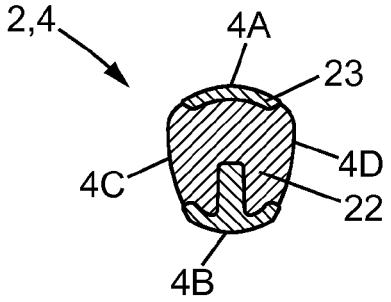

As depicted in FIGS. 11A to 11K, which are cross sections taken all along the razor handle 2 as depicted in FIG. 10, the razor handle 2 has, in cross section, a general trapezoidal shape with smooth corners, except in a zone located near the center of the razor handle 2. In this particular zone, the general shape of the razor handle 2 in cross section is more triangular, as depicted in FIG. 11H.

Figure 11I:
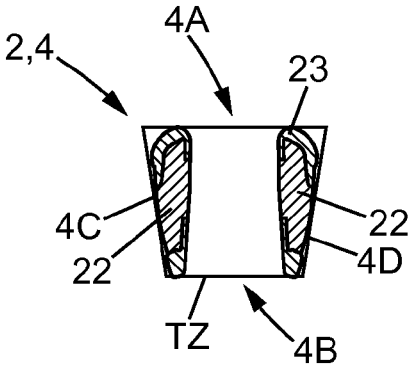

This general trapezoidal shape is highlighted on the figures by a virtual trapeze TZ put for instance on FIGS. 11D, 11E and 11I. A trapezoidal shape has four different faces for the fingers to rest on, whereas a triangular shape only has three different faces. Also, due to its general trapezoidal shape, the razor handle 2 thus has better and larger areas for finger gripping. This particular trapezoidal shape thus facilitates a comfortable grasping and shaving.

It can further be seen in FIGS. 11A to 11I that the upper face 4A and the lower face 4B are convex, except for the lower face 4B in the vicinity of the front end 2A (i.e. where the connecting means 5 has a concave portion designed for facilitating hand grasping), and also except in the vicinity of the rear end 2B.

The connecting means 5 are integral with the elongated body 4 and that includes two flexible arms 6 extending from the elongated body 4 and protruding toward a free end 6B at the front end 2A of the razor handle 2. In other words, the flexible arms 6 and the elongated body 4 are unitary.

Figure 9:
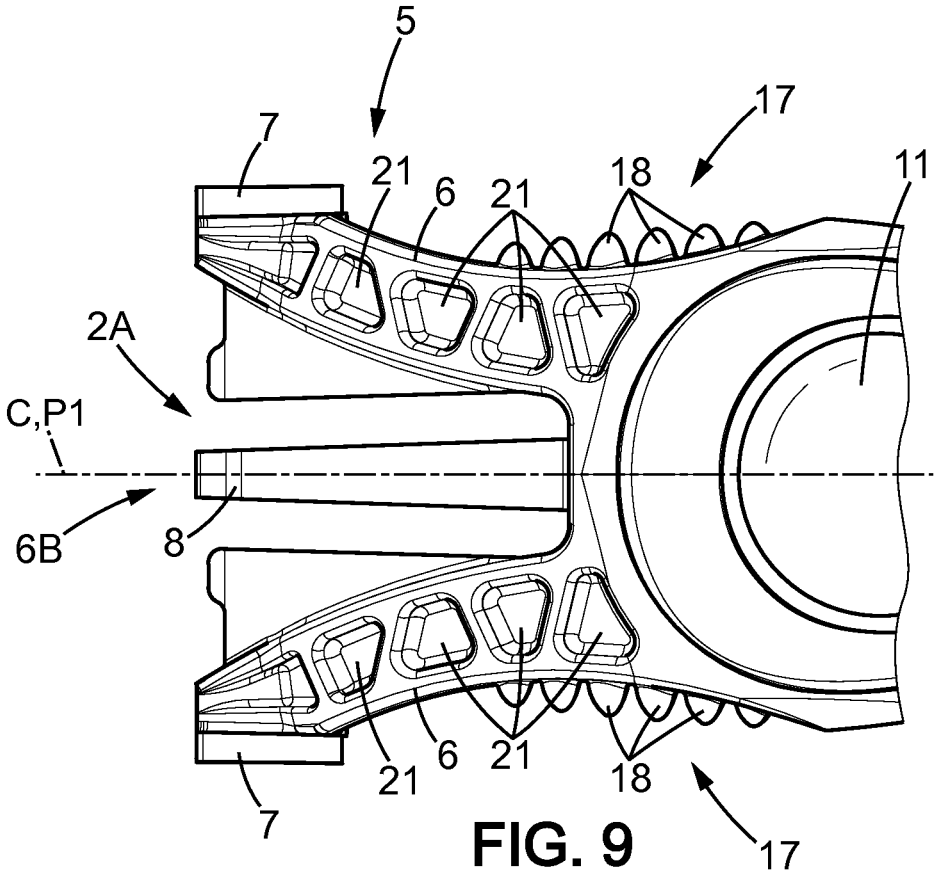
FIG. 9 is a partial upper view of the front end of the razor handle of FIG. 3A.

As depicted on FIG. 9, the two arms 6 may be disposed in a V shape, diverging from the longitudinal direction C of the razor handle 2 each provided, at the free end 6B, with a bearing structure 7 for connection to the shaving cartridge 3. In the disclosed embodiment, the shaving cartridge 3 is of the pivotal type, the bearing structures 7 allowing the pivoting of the shaving cartridge 3 when connected to the razor handle 2, whereas a longitudinal flexible tongue 8, extending between the arms 6 and cooperating with a groove 8A formed on the shaving cartridge 3, provides a spring force which biases the shaving cartridge 3 towards a rest position as illustrated in FIG. 1. However, the shaving cartridge 3 may also be fixed relatively to the razor handle 2.

Each arm 6 further has on its upper face a plurality of small cavities 21. Such a structure provides enough structural strength to the connecting means 5 for the purposes of human shaving, while saving weight and costs on this part of the razor handle 2. More precisely, the arms 6 and the flexible tongue 8 have a squared shape with smooth corners, allowing an improved robustness of the connecting means 5.

The elongated body 4 has an outer surface 4E, and more precisely an upper face 4A and a lower face 4B as depicted on FIGS. 4A and 4B, the lower face 4B being opposite the upper face 4A. The elongated body 4 further has two lateral sides 4C, 4D comprised between the upper and lower faces 4A, 4B, opposite each other and also extending in the longitudinal direction C.

The elongated body 4 and the connecting means 5 form a unitary element moulded out of a first material 22. The first material 22 may be any moldable material. Preferably, the first material 22 is chosen among the plastics and the rubbers. For instance, the elongated body 4 and the connecting means 5 can be moulded in a thermoplastic material, for instance in acrylonitrile butadiene styrene (ABS) or in polypropylene (PP).

The elongated body 4 further includes a first hole 9 and a second hole 10. The first and second holes 9, 10 are respectively located in the first enlarged part Ep1 and in the second enlarged part Ep2 of the razor handle 2.

The first and second holes 9, 10 are preferably through-holes that extend between the upper face 4A and the lower face 4B of the elongate body 4. However, the first and second holes 9, 10 may also be blind holes that open on the outer surface 4E of the elongated body 4, and in particular on the upper face 4A or on the lower face 4B.

Figure 8:
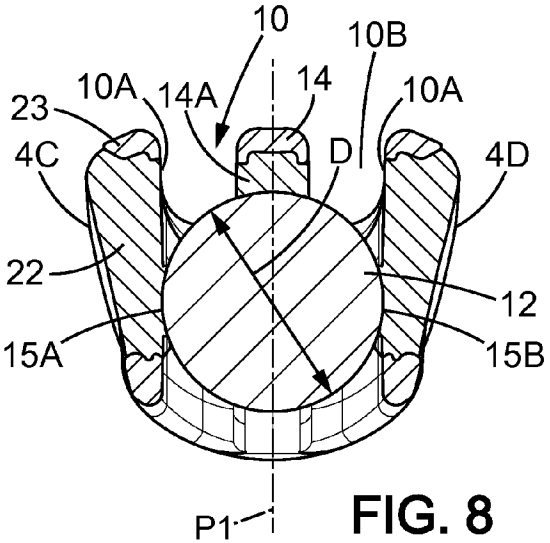
FIG. 8 is a section of the razor handle shown in FIG. 3A along line VIII-VIII.
Figure 7:
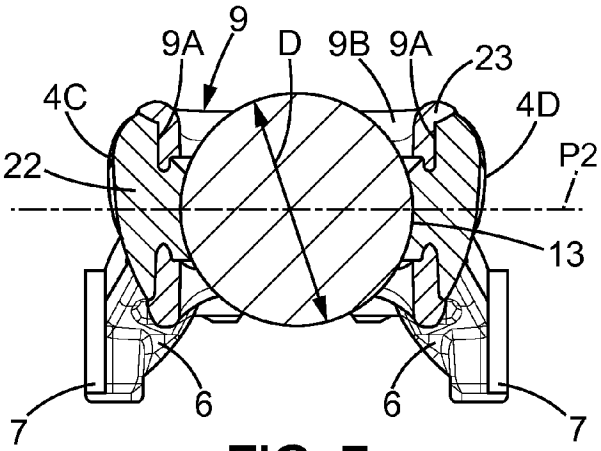
FIG. 7 is a section of the razor handle shown in FIG. 3A along line VII-VII.

As shown in FIGS. 7 and 8, each of the first and second holes 9, 10 has respectively an interior side wall 9A, 10A, each of which delimiting an interior space 9B, 10B comprised inside the elongated body 4 between the upper and the lower faces 4A, 4B. More particularly, the interior side walls 9A, 10A of each of the first and second holes 9, 10 comprise a semi-circular portion 9C, 10C and converge in a V-shape from these semi-circular portion 9C, 10C in the longitudinal direction C towards the slim part Sp in the centre of the razor handle 2. Also, both of the first and second holes 9, 10 preferably have drop-shapes respectively oriented in opposite direction when seen from an upper or a lower view as illustrated in FIGS. 3A and 3B. In other words, viewed from the top or lower side, the two holes connected via the slim part Sp, have a general shape forming a kind of eight.

Figure 12:
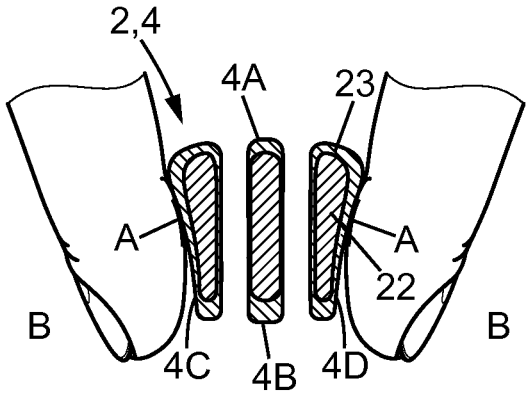
FIG. 12 is a view of finger gripping of the razor handle according to a first embodiment.
Figure 13:
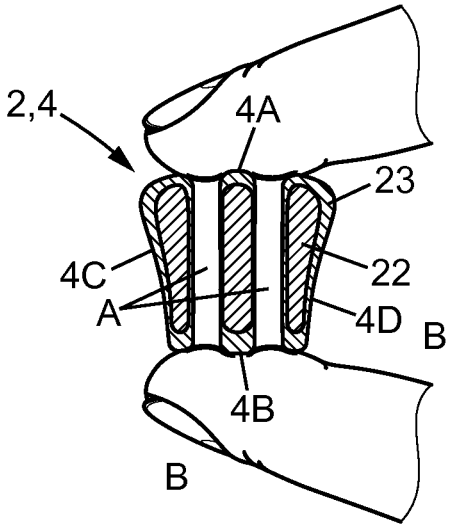
FIG. 13 is a view of finger gripping of the razor handle according to another embodiment.

As seen on FIG. 12 which represents finger gripping of the razor handle 2 in a cross sectional view, when the user's fingers rest on the lateral sides 4C, 4D of the elongated body 4 (at points A), the air pressure is the same inside the first and second holes 9, 10 and around the razor handle 2 (at points B). However, as depicted on FIG. 13, when the user positions his fingers on both the upper and lower faces 4A, 4B of the elongated body 4, the surface of the fingers conform to the shape of the hole, for instance to the shape of the second hole 10.

The length L9 of the first hole 9 along the longitudinal direction is comprised between 10 mm and 30 mm, preferably about 20 mm. The length L10 of the second hole 10 along the longitudinal direction is comprised between 30 mm and 50 mm, preferably about 40 mm. Also, as illustrated in FIG. 3B, the first enlarged part Ep1 extends from the connecting means 5 to the end of the first hole 9 located towards the centre of the razor handle 2. The slim part Sp extends from this end of the first hole 9 located towards the centre of the razor handle 2 to the end of the second hole 10 also located towards the centre of the razor handle 2. The second enlarged part Ep2 extends from the end of the second hole 10 located towards the centre of the razor handle 2 to the rear end 2B.

Figure 5:
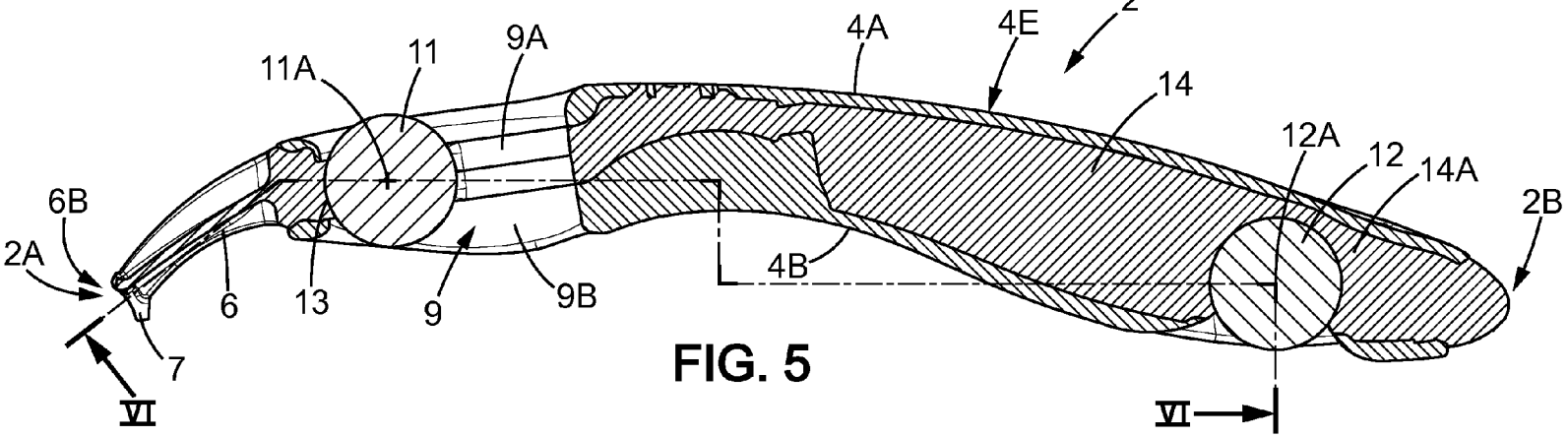
FIG. 5 is a longitudinal section of the razor handle shown in FIG. 3A along line V-V.
Figure 6:
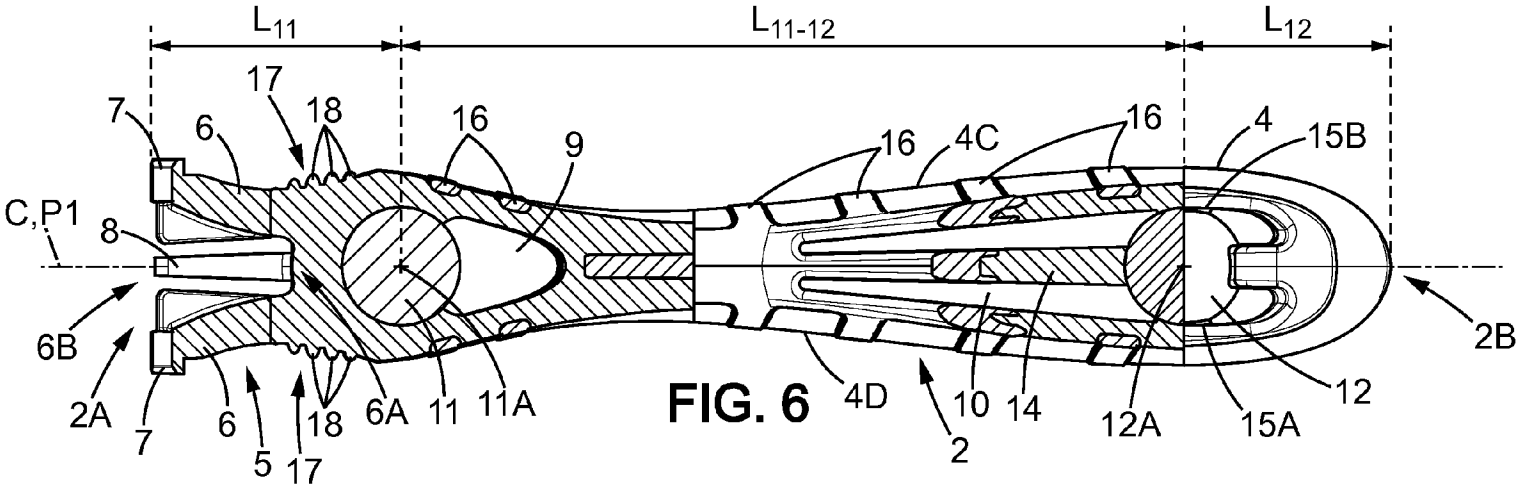
FIG. 6 is a section of the razor handle shown in FIG. 5 along line VI-VI.

The razor handle 2 further that includes a first insert 11 and a second insert 12 located respectively within the interior space 9B, 10B of each first and second holes 9, 10. More precisely, the first and second inserts 11, 12 are respectively partially encapsulated within the first and second holes 9, 10 as illustrated in FIG. 5. Besides, the surface of the first and second inserts 11, 12 can be directly or indirectly, as detailed hereafter, touchable with a finger of a user. Besides, the surface of each of the first and second inserts 11, 12 can form finger rest areas on the upper face 4A and/or on the lower face 4B of the elongated body 4. Preferably, less than 75%, and preferably less than 50% of the surfaces of the first and second inserts 11, 12 are encapsulated within the first and second holes 9, 10. In other words, the surface of the first and second inserts 11, 12 which is encapsulated cannot be directly touchable by the user as it is surrounded with the first material 22 of the elongated body 4.

In this manner, when a user wants to shave, he may position his fingers on the location of the first and second holes 9, 10, and preferably on the surfaces of the first and second inserts 11, 12 which are not encapsulated. Preferably, the first and second inserts 11, 12 enhance hand grasping in certain shaving positions, such as in a position where the razor handle 2 is held between the index and the thumb, the thumb resting on the first insert 11 on the upper face 4A whereas the index rests on the first insert 11 on the lower face 4B of the razor handle 2. In another shaving position, the thumb and the index of the user can also rest on the second insert 12. As it will be detailed below, the second insert 12 may not be directly touchable with a finger of a user on the upper face 4A as a rib 14 may cover partially the second insert 12. The user may therefore position his finger(s) on the rib 14 on the upper face 4A of the elongated body 4 when shaving. Although covered by the rib 14, the second insert 12 however forms a finger rest area since it supports the rib 14. In other means, it is like the second insert 12 would be covered at least partially with another material (i.e. the material of the rib 14).

The first and second inserts 11, 12 are preferably made in a material chosen among the metals, the plastics and the rubbers. In particular, the first insert 11 and/or the second insert 12 is preferably made in a rigid material having a density that is significantly different from the density of the first material 22 of the elongated body 4.

For instance, the density of the first and second inserts 11, 12 may be greater than the density of the first material 22 of the elongated body 4. The first and second inserts 11, 12 thus contribute to raise weight of the razor handle 2 without significantly increasing the volume of the handle 2. As a consequence, the razor handle 2 can be heavy enough to provide a good shaving and to make sure that a good contact is provided between the blades 3A of the shaving cartridge 3 and the skin of the user to be shaved. Preferably, each of the first and second inserts 11, 12 is only made of metal and does not comprise any other material.

The material chosen for the first insert 11 and/or the second insert 12 may also have an impact on the sensing experience of the user when he positions his fingers on the first and second inserts 11, 12. As an example, an insert made of metal provides a pin-point contact with the fingers of the user, thus allowing the communication of all transmitted vibrations from shaving. To the contrary, an insert made of rubber, such as thermoplastics, absorbs most of the vibrations from shaving and does not transmit them to the fingers of the user.

As an alternative, the first and second inserts 11, 12 may not be both necessarily in the same material. For instance, the first insert 11 provided within the first hole 9 may be made of metal and the second insert 12 provided within the second hole 10 may be made of rubber or vice versa. As another alternative, the first insert 11 may be a sphere in metal and the second insert 12 may be a sphere in rubber. According to this last alternative, the first insert 11, which is thus in metal, reinforces the comfort feeling and handle control when a user places his/her index finger on it. It also enhances the directional tactile feedback of the user due to the difference of texture, temperature and shape that exist between the first insert 11 in metal and the first material 22 of the elongated body 4. The second insert 12, which thus is a sphere, enriches the softness when placing the fingers on the razor handle 2. It also enhances the visual continuity with the first insert 11 in this particular alternative in which the first insert 11 is a metal sphere.

Besides, each of the first and second inserts 11, 12 can also be made with several materials. In particular, the first and second inserts 11, 12 can be covered with a layer of another material having a smooth surface. As an example, the first and second inserts 11, 12 may be made of metal and covered by a layer of rubber. In this embodiment, the layer can have a surface finish comprised between 0.5 μm and 1.6 μm (roughness Ra).

The first and second inserts 11, 12 may also have an irregular surface, for instance with craters or bumps due to a knurled pattern or a divot pattern. As a matter of fact, the type of surface of the first and second inserts 11, 12 affect the tactile sensing of the user when he positions his fingers on the first and second inserts 11, 12.

As another alternative, the first insert 11 and/or the second insert 12 may be a sphere of which one hemisphere is made of rubber and the other hemisphere is made of plastic. The first and second inserts 11, 12 may thus serve a double purpose by providing different types of finger rest areas.

Due to the first and second inserts 11, 12, the elongated body 4 can therefore be in a material which is lighter and cheaper when compared to the material used in known razor handles. Nevertheless, despite the lightness of the first material 22, the razor handle 2 still has a good quality appearance and an optimized weight thanks to the first and second inserts 11, 12. Besides, the weight of the razor handle 2 is chosen to be localized in the front end 2A and the rear end 2B of the razor handle 2, thus ensuring a good balance of the razor handle 2.

The first insert 11 and/or the second insert 12 may have a spherical shape. The first inserts 11 and/or the second insert 12 may have an ovoid shape. More generally, the inserts may have any other shape such as a parallelipipedic, cubical or cylindrical shape. Besides, the first and second inserts 11, 12 may have the same shape or may have a different one. Similarly, first and second inserts 11, 12 may have the same dimensions or may have different ones. Besides, the first and second inserts 11, 12 may comprise the same material(s) or may comprise a different one(s).

Preferably, the inclusion of the first and second inserts 11, 12 does not lead to an excessive deformation of the shape of the elongated body 4. Besides, the shape of the elongated 4 preferably remains similar to the shape of an elongated body that would not include any insert. As depicted on the FIGS. 1-3 and 5-8, each of the first and second inserts 11, 12 is preferably a single sphere. However, each of the first and second inserts 11, 12 may not be complete spheres and may only comprise a partial curved surface, especially a partial spherical surface which serves as a finger rest area.

Besides, the first and second inserts 11, 12 have a size which is respectively inferior to the interior spaces 9B, 10B of each first and second hole 9, 10. Also, as illustrated on FIGS. 4A and 3B, the length of the first and second holes L9, L10 in the longitudinal direction C is greater than the longitudinal size of the first and second inserts 11, 12. More particularly, in the particular embodiment in which the inserts are spheres as depicted on the figures, such spheres have preferably a diameter D which is comprised between 10 mm and 20 mm, preferably inferior to 15 mm, and more preferably of about 12 mm.

In one embodiment, the first and second inserts 11, 12 are preferably maintained, advantageously secured, respectively within the first and second holes 9, 10 and can therefore not be detached from the first and second holes 9, 10 by a user. Besides, the first and second inserts 11, 12 cannot move in any manner in the first and second holes 9, 10. As a consequence, the first and second inserts 11, 12 are not movable (i.e. immovable or motionless) respectively relative to the first and second holes 9, 10. The non-movable first and second inserts 11, 12 thus form finger rest areas. More precisely, the first and second inserts 11 and 12 cannot slide in their corresponding first and second holes 9, 10.

More particularly, as depicted in FIG. 7, a retaining ring 13 protrudes from the interior side wall 9A of the first hole 9 in a plane P2 perpendicular to the symmetry plane P1 of razor handle 2 and surrounds circumferentially partially the first insert 11 for maintaining the first insert 11 within the first hole 9.

However, in another embodiment, the first insert 11 and/or the second insert 12 may be a sphere that can rotate on itself about its own axis in all directions. Also, a gap may be provided between the first insert 11 and the retaining ring 13 in order to facilitate the rotation of the first insert 11 when it is a sphere. The gap may be comprised between 0.005 μm and 0.025 μm depending on the chosen rotational freedom of the first insert 11. A smaller gap prevents the first insert 11 from rotating easily whereas a bigger gap facilitates the rotation. The surface finish of the first insert 11 and/or the second insert 12 and/or of the first hole 9 and/or the second hole 10 is adapted to allow this movability, especially the rotation.

Thus, in that case, one among the first insert 11 and/or the second insert can be immovable.

In another embodiment, both the first insert 11 and the second insert 12 are movable. The first insert 11 and the second insert 12 can for instance be spheres that are movable, especially in sliding around their own axis within their corresponding first and second holes 9, 10.

In the case where the first and/or second inserts 11, 12 comprise two hemispheres made of different materials and thus having different density, the user can switch between the two hemispheres as needed by rotating the first and second inserts 11, 12.

A user that may position one of his fingers on such a movable first insert 11 and/or second insert 12 will find difficult to shave as his finger(s) will constantly slip on the first insert 11 and/or the second insert 12. Shaving will therefore be imprecise and uncomfortable.

As a consequence, when the first or second insert 11, 12 is movable respectively relative to corresponding first or second holes 9, 10, it cannot form fingers rest areas. More precisely, when the first insert 11 is movable, it cannot be a finger rest area.

As illustrated in FIG. 8, the second hole 10 is divided in two parts by an elongated bar 14 extending in the longitudinal direction C and within the second hole 10 in the plane P1. The elongated bar 14 that includes a portion 14A that surrounds circumferentially partially the second insert 12 for maintaining the second insert 12 within the second hole 10. The interior side wall 10A of the second hole 10 also that includes two small projections 15A, 15B opposite each other, protruding from the interior side wall 10A, and having a shape which is partly complementary to the shape of the second insert 12 for maintaining the second insert 12 within the second hole 10. However, as described above regarding the first insert 11, a gap may also be provided between the second insert 12 and the portion 14A in order to facilitate the rotation of the second insert 12 when this second insert 12 is a sphere.

By being respectively maintained in the first and second holes 9, 10, the first and second inserts 11, 12 are respectively located in the front end 2A and the rear end 2B of the razor handle 2. Preferably, the first insert 11 is centered on a first point 11A which is located at a distance L11 measured along the longitudinal direction (C) of about 25 mm from the front end 2A. The second insert 12 is located in the vicinity of the rear end 1B. Preferably, the second insert 12 is centered on a second point 12A which is located at a distance L12 measured along the longitudinal direction C of about 25 mm from the rear end 2B.

As illustrated on FIG. 5, in the particular embodiment in which the first and second inserts 11, 12 are spheres, the first point 11A and the second point 12A respectively correspond to the centre of the first and second inserts 11, 12.

The distance L11-12 between the first point 11A and the second point 12A measured along the longitudinal direction (C) is preferably comprised between 60 mm and 100 mm, preferably of about 78 mm. However, this distance L11-12 may vary depending on the length L4 of the elongated body 4 as well as on the weight balance to be preferred due to the first and second inserts 11, 12.

In particular, known razors without inserts usually have a center of balance that is located in the center of the razor handle, or slightly towards the front end toward the razor handle. To this end, the rear part of the razor handle cannot be much larger than its front part, and vice versa, in order to achieve this center of balance. In the embodiment of the present invention, by adding the first and second inserts 11, 12 at precise locations from the front end 2A and the rear end 2B of the razor handle 2, it is possible to control the location of this center of balance regardless the shape of the razor handle 2. For instance, the center of balance may be positioned at the center of the razor handle 2 in the longitudinal direction (C) even though the second enlarged part Ep2 is significantly larger than the first enlarged part Ep1.

The elongated body 4 may comprise several different materials. For instance, the elongated body 4 may also comprise a layer of a second material 23 different from the first material 22, preferably chosen among the plastics and the rubbers. The first material 22 provides structural strength to the razor handle 2, while the second material 23 provides the softness required for comfortable hand grasping and firm finger gripping in any shaving position.

As depicted in FIGS. 3A and 3B, at least a part 19 of the upper face 4A and at least a part 20 of the lower face 4B, and preferably the majority of these faces 4A, 4B, can be covered with the second material 23 so that the parts 19, 20 respectively form an upper gripping area and a lower gripping area.

As can be seen, for example, on FIGS. 11A-11K, the second material 23 covers the majority, preferably all, of the upper face 4A of the elongated body 4. The second material 23 also covers the majority, preferably all, of the lower face 4B of the elongated body 4.

Figure 11J:
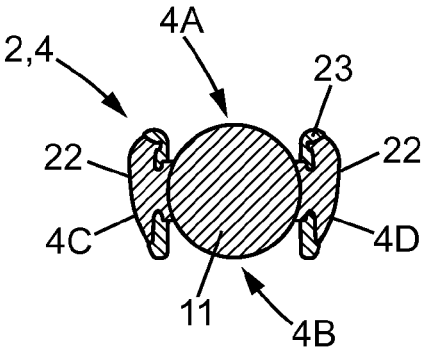
Figure 11K:
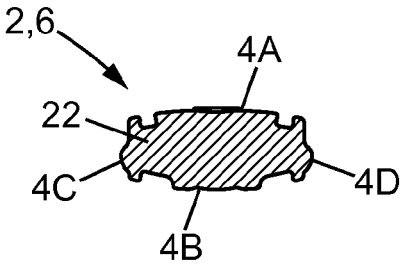

As depicted in FIGS. 7 and 11J, the second material 23 may also overflow, at least partially, on the interior side wall 9B of the first hole 9 without covering the retaining ring 13 which maintains the first insert 11.

The lateral sides 4C, 4D of the elongated body 4 further that includes a plurality of smooth ribs 16 made of the second material 23. As shown in FIG. 4, each lateral side 4C, 4D of the elongated body 4 that includes preferably a plurality of ribs 16 connecting together the upper and lower gripping areas 19, 20. In the particular embodiment shown in FIG. 4, each of the lateral sides 4C, 4D of the first enlarged part Ep1 that includes two ribs 16 and the lateral sides 4C, 4D of the second enlarged part Ep2 that includes four ribs 16.

As depicted on FIGS. 1-4 and 9, each lateral side 3C, 4D may also comprise a side gripping area 17 that includes a plurality of spaced protruding pins 18 integral with the connecting means 5 and located in the vicinity of the front end 2A of the razor handle 2 at the junction of the connecting means 5 with the elongated body 4. The side gripping areas 17 enhance finger gripping of the razor handle 2, especially in a shaving position where the thumb and the index finger are positioned very close to the front end 2A, and preferably to the arms 6 for satisfying the need of precise shaving.

According to an embodiment of the present invention, the insert (first and/or second) can be movable or immovable in its corresponding hole; besides, the insert (first and/or second) can be a sphere or of any other shape allowing the movability of the insert. The material and/or the surface finish of the insert (first and/or second) and/or of the hole (first and/or second) is adapted to allow this movability, especially by rotation. Besides, the insert (first and/or second) even when movable is not detachable from the handle when inserted in the corresponding hole.

The invention claimed is:

1. A razor handle comprising an elongated body extending in a longitudinal direction, the elongated body having an outer surface and being provided with a first hole and a second hole, the first and second holes opening on the outer surface of the elongated body, the razor handle further comprising a first insert and a second insert, wherein the first and second inserts have a size which is smaller than the first and second holes, respectively, such that the first and second inserts are at least partially encapsulated within the first and second holes.

2. The razor handle according to claim 1, wherein the razor handle extends between a front end and a rear end, the rear end being opposite the front end, the front end being provided with a connecting means, wherein the first insert is located in the vicinity of the front end and wherein the first insert is immovable within the first hole, the immovable first insert forming a finger rest area.

3. The razor handle according to claim 1, wherein the first insert is movable within the first hole.

4. The razor handle according to claim 1, wherein the second insert is immovable within the second hole, the immovable second insert forming a finger rest area.

5. The razor handle according to claim 1, wherein the elongated body is a unitary element and comprises a first material chosen among plastics and rubbers.

6. The razor handle according to claim 5, wherein the first and second inserts are made in a rigid material having a density that is different from the density of the first material of the elongated body.

7. The razor handle according to claim 1, wherein the first and second inserts comprise a material chosen among metals, plastics and rubbers.

8. The razor handle according to claim 1, wherein at least one of the first and second inserts is a sphere.

9. The razor handle according to claim 8, wherein at least one of the first and second inserts has a diameter between 10 mm and 20 mm.

10. The razor handle according to claim 1, wherein the elongated body has an upper face and a lower face, the lower face being opposite the upper face, the first and second holes being through holes extending between the upper and lower faces.

11. The razor handle according to claim 1, wherein the elongated body has an upper face and a lower face, the lower face being opposite the upper face, at least a part of the upper face and at least a part of the lower face being covered with a second material so that the parts respectively form at least an upper gripping area and at least a lower gripping area.

12. The razor handle according to claim 11, wherein the elongated body has two lateral sides opposite each other and extending in the longitudinal direction between the upper and lower faces, the lateral sides comprising a plurality of smooth ribs made of the second material, each of the smooth ribs connecting together the upper gripping area and the lower gripping area.

13. The razor handle according to claim 12, wherein each of the lateral side comprises a plurality of spaced protruding pins in the vicinity of the front end of the razor handle.

14. The razor handle according to claim 1, wherein the razor handle extends between a front end and a rear end, the rear end being opposite the front end, the front end being provided with connecting means for connection to a shaving cartridge.

15. The razor handle according to claim 14, wherein the razor handle has, in cross section, a general trapezoidal shape with smooth corners in the vicinity of the rear end.

16. The razor handle according to claim 14, wherein the first insert is located in the vicinity of the front end, whereas the second insert is located in the vicinity of the rear end.

17. The razor handle according to claim 16, wherein the second insert is centered on a second point which is located at a distance measured along the longitudinal direction of about 20 mm from the rear end.

18. The razor handle according to claim 16, wherein the first insert is centered on a first point which is located at a distance measured along the longitudinal direction of about 30 mm from the front end.

19. The razor handle according to claim 18, wherein the distance between the first point and the second point measured along the longitudinal direction is comprised between 70 mm and 90 mm.

20. The razor handle according to claim 1, wherein the first hole has an interior lateral wall, a retaining ring protruding from the interior lateral wall and surrounding circumferentially, at least partially, the first insert for maintaining the first insert within the first hole.

21. The razor handle according to claim 1, wherein the second hole is divided by an elongated bar extending in the longitudinal direction, the elongated bar comprising a portion that surrounds circumferentially, at least partially, the second insert for maintaining the second insert within the second hole.

22. The razor handle according to claim 1, wherein the second hole comprises an interior lateral wall, the second hole further comprises two projections opposite each other, protruding from the interior lateral wall, and having a shape which is partly complementary to the shape of the second insert for maintaining the second insert within the second hole.

23. The razor handle according to claim 1, wherein each of the first and second holes, respectively, has an interior side wall, wherein said interior side wall of each of the first and second holes delimits an interior space comprised inside the elongated body.

24. The razor handle according to claim 1, wherein the razor handle has, in cross section, a general trapezoidal shape with smooth corners.

25. A razor comprising a razor handle according to claim 1, and a shaving cartridge connected to the razor handle.

26. A razor handle comprising an elongated body extending in a longitudinal direction, the elongated body having an outer surface and being provided with a first hole, the first hole opening on the outer surface of the elongated body, the razor handle further comprising a first insert, the first insert being a sphere which has a size which is smaller than the first hole such that the first insert is at least partially encapsulated within the first hole and the razor handle having, in cross section, a general trapezoidal shape with smooth corners in the vicinity of the first hole.

27. The razor handle according to claim 26, wherein the elongated body has an upper face and a lower face, the lower face being opposite the upper face, at least a part of the upper face and at least a part of the lower face being covered with a second material so that the parts form at least an upper gripping area and at least a lower gripping area.

28. The razor handle according to claim 27, wherein the elongated body has two lateral sides opposite each other and extending in the longitudinal direction between the upper and lower faces, the lateral sides comprising a plurality of smooth ribs made of the second material, each of the smooth ribs connecting together the upper gripping area and the lower gripping area.

29. The razor handle according to claim 26, wherein the razor handle extends between a front end and a rear end, the rear end being opposite the front end, the front end being provided with connecting means for connection to a shaving cartridge.

30. The razor handle according to claim 29, wherein the razor handle has, in cross section, a general trapezoidal shape with smooth corners in the vicinity of the rear end.

31. The razor handle according to claim 26, wherein the first hole has an interior lateral wall, a retaining ring protruding from the interior lateral wall and surrounding circumferentially, at least partially, the first insert for maintaining the first insert within the first hole.

32. The razor handle according to claim 26, wherein the razor handle has, in cross section, a general trapezoidal shape with smooth corners.

33. A razor comprising a razor handle according to claim 26, and a shaving cartridge connected to the razor handle.

* * * * *